US008197392B2

(12) United States Patent
Silverman et al.

(10) Patent No.: US 8,197,392 B2
(45) Date of Patent: Jun. 12, 2012

(54) SUSPENDIBLE EXERCISE STRAPS

(75) Inventors: Ben Silverman, Richmond (CA); Joel Richard Grenz, Surrey (CA); Darren Shane, Richmond (CA)

(73) Assignee: Astone Fitness Ltd., Richmond, British Columbia (CA)

( * ) Notice: Subject to any disclaimer, the term of this patent is extended or adjusted under 35 U.S.C. 154(b) by 0 days.

(21) Appl. No.: 12/849,389

(22) Filed: Aug. 3, 2010

(65) Prior Publication Data

US 2012/0035031 A1 Feb. 9, 2012

(51) Int. Cl.
*A63B 21/002* (2006.01)
*A63B 21/068* (2006.01)

(52) U.S. Cl. ..... 482/91; 482/96; 482/904

(58) Field of Classification Search ..... 482/91, 482/92, 95, 96, 114, 120–133, 139, 904, 482/907; 182/196–198
See application file for complete search history.

(56) References Cited

U.S. PATENT DOCUMENTS

| | | | | |
|---|---|---|---|---|
| 223,799 | A * | 1/1880 | Butler | 482/139 |
| 3,739,772 | A * | 6/1973 | Ennis | 602/4 |
| 4,220,328 | A * | 9/1980 | Crush, Jr. | 482/92 |
| 5,209,712 | A * | 5/1993 | Ferri | 482/91 |
| 5,370,286 | A * | 12/1994 | Newman | 224/578 |
| 5,518,486 | A * | 5/1996 | Sheeler | 482/131 |
| 6,047,665 | A * | 4/2000 | Deveaux | 119/770 |
| 6,113,564 | A * | 9/2000 | McGuire | 602/32 |
| D454,235 | S * | 3/2002 | Kaplan | D30/153 |
| 6,726,606 | B2 * | 4/2004 | Jacobsen | 482/121 |
| 7,044,896 | B2 | 5/2006 | Hetrick | |
| 7,090,622 | B2 | 8/2006 | Hetrick | |
| 7,096,827 | B2 * | 8/2006 | Sporn | 119/797 |
| 7,293,531 | B2 * | 11/2007 | Young, III | 119/798 |
| 7,651,448 | B2 | 1/2010 | Hetrick | |
| D612,436 | S * | 3/2010 | Schirmer | D21/662 |
| 7,722,508 | B2 | 5/2010 | Hetrick | |
| 7,743,735 | B2 * | 6/2010 | Weinberg | 119/795 |
| 7,762,932 | B2 * | 7/2010 | Hetrick | 482/91 |
| 7,785,244 | B2 | 8/2010 | Hetrick | |
| 7,806,814 | B2 | 10/2010 | Hetrick | |
| 8,007,413 | B1 * | 8/2011 | Wu | 482/91 |
| 8,043,197 | B2 * | 10/2011 | Hetrick | 482/91 |
| 2007/0027005 | A1 | 2/2007 | Hetrick | |
| 2007/0173383 | A1 * | 7/2007 | Feigenbaum et al. | 482/91 |

(Continued)

FOREIGN PATENT DOCUMENTS

| | | |
|---|---|---|
| CA | 2521859 | 10/2004 |

(Continued)

OTHER PUBLICATIONS

Jungle Gym, webpage (http://www.lifelineusa.com/products/jungle-gym.html).

(Continued)

*Primary Examiner* — Loan Thanh
*Assistant Examiner* — Daniel F. Roland
(74) *Attorney, Agent, or Firm* — Smiths IP

(57) ABSTRACT

An exercise strap comprises an upper strap and a lower strap. A plurality of loop members are located on the lower strap to allow for handles to be easily removed and replaced on different locations on the lower strap. An adjustment member attached to both the upper strap and the lower strap allows for the overall length of the exercise strap to be adjusted. A strap attachment member attached to the upper strap connects the exercise strap to a suitable mounting mechanism.

10 Claims, 11 Drawing Sheets

U.S. PATENT DOCUMENTS

| | | | | |
|---|---|---|---|---|
| 2009/0075787 | A1 | 3/2009 | Hetrick | |
| 2009/0075789 | A1 | 3/2009 | Hetrick | |
| 2009/0075790 | A1* | 3/2009 | Hetrick | 482/92 |
| 2009/0105053 | A1 | 4/2009 | Hetrick | |
| 2010/0267531 | A1 | 10/2010 | Hetrick | |
| 2011/0224055 | A1* | 9/2011 | Kassel | 482/121 |
| 2011/0269608 | A1* | 11/2011 | Eubanks | 482/139 |

FOREIGN PATENT DOCUMENTS

| | | |
|---|---|---|
| CA | 2628774 | 7/2007 |
| CA | 2699777 | 3/2009 |
| CA | 2699778 | 3/2009 |
| CA | 2699963 | 3/2009 |
| CA | 2699972 | 3/2009 |
| CA | 2715413 | 3/2009 |

OTHER PUBLICATIONS

TRX Suspension Training Pro Pack, webpage (http://www.trxtraining.com/page/000-94127/PROD/TRXPACK).

AirFit Trainer Basic, webpage (http://shop.purmotion.net/product.sc?producId+2&categoryId=7).

* cited by examiner

SUSPENDIBLE EXERCISE STRAPS

FIELD OF THE INVENTION

This invention relates to exercise straps suspended from above that are used for performing various strength, conditioning, or stretching exercises.

BACKGROUND OF THE INVENTION

Conventional exercise straps are typically attached to the top of a door (or some other elevated structure) and extend downwards, towards the ground. In so-called "single" suspension systems, a single strap extends downwards from the top of the door and then splits into two straps. A handle is attached to the ends of each of the two respective straps. A person places his or her hands in the handles and can perform various exercises, including push-ups and dips. Examples of single suspension systems are the TRX device manufactured by Fitness Anywhere, Inc. and the AirFit device manufactured by PurMotion, LLC. One disadvantage of single suspension systems is that because the distance between the split and the ends of the two straps is relatively short, the two straps may rub against the neck, ears, and head of the person during exercising.

In "dual" suspension systems, instead of a single strap being attached to the top of a door, two straps are attached to the top, and each strap extends downwards. A handle is attached to the ends of each strap. An example of a dual suspension system is the Jungle Gym Split device manufactured by LifelineUSA.

In conventional single and dual suspension systems, the lengths of the straps are typically adjusted using cam buckles located somewhere along the straps. It is often necessary to adjust the lengths of the straps in order to provide differing degrees of difficulty for the exercise. For example, the lower the handles are to the ground (i.e. the longer the straps are), the more difficult it would be for the person to perform push-ups from that position. However, it takes time to properly adjust the length of the straps using the cam buckles. In particular, where there are cam buckles on each of the two straps, the two cam buckles have to be individually adjusted to ensure that both straps are of equal length.

It is therefore an object of this invention to provide exercise straps that allow the person to quickly and easily adjust the position of the handles.

This and other objects of the invention will be better understood by reference to the detailed description of the preferred embodiment which follows. Note that not all of the objects are necessarily met by all embodiments of the invention described below or by the invention defined by each of the claims.

SUMMARY OF THE INVENTION

The exercise strap according to the invention comprises an upper strap and a lower strap. A strap attachment member is fixed on the upper strap and a plurality of loop members is located on the lower strap. An adjustment member is attached to both the upper strap and the lower strap, and a portion of one or both of the upper strap and lower strap slides through the adjustment member.

In another aspect of the invention, the upper strap and the lower strap are made of an inelastic material, such as nylon. The strap attachment member may be fixed to one end of the exercise strap and may be a carabiner. The loop members may be D-rings and may be adapted to attach to an exercise accessory.

In yet another aspect of the invention, the adjustment member is a cam buckle that is fixedly attached to the upper strap and allows the lower strap to slide through it.

In still another aspect of the invention, the exercise strap according to the invention comprises a strap, a strap attachment member fixed on the strap, and a plurality of loop members located on the strap.

The foregoing was intended as a broad summary only and of only some of the aspects of the invention. It was not intended to define the limits or requirements of the invention, and therefore, the claims may include aspects not specifically identified in this section. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
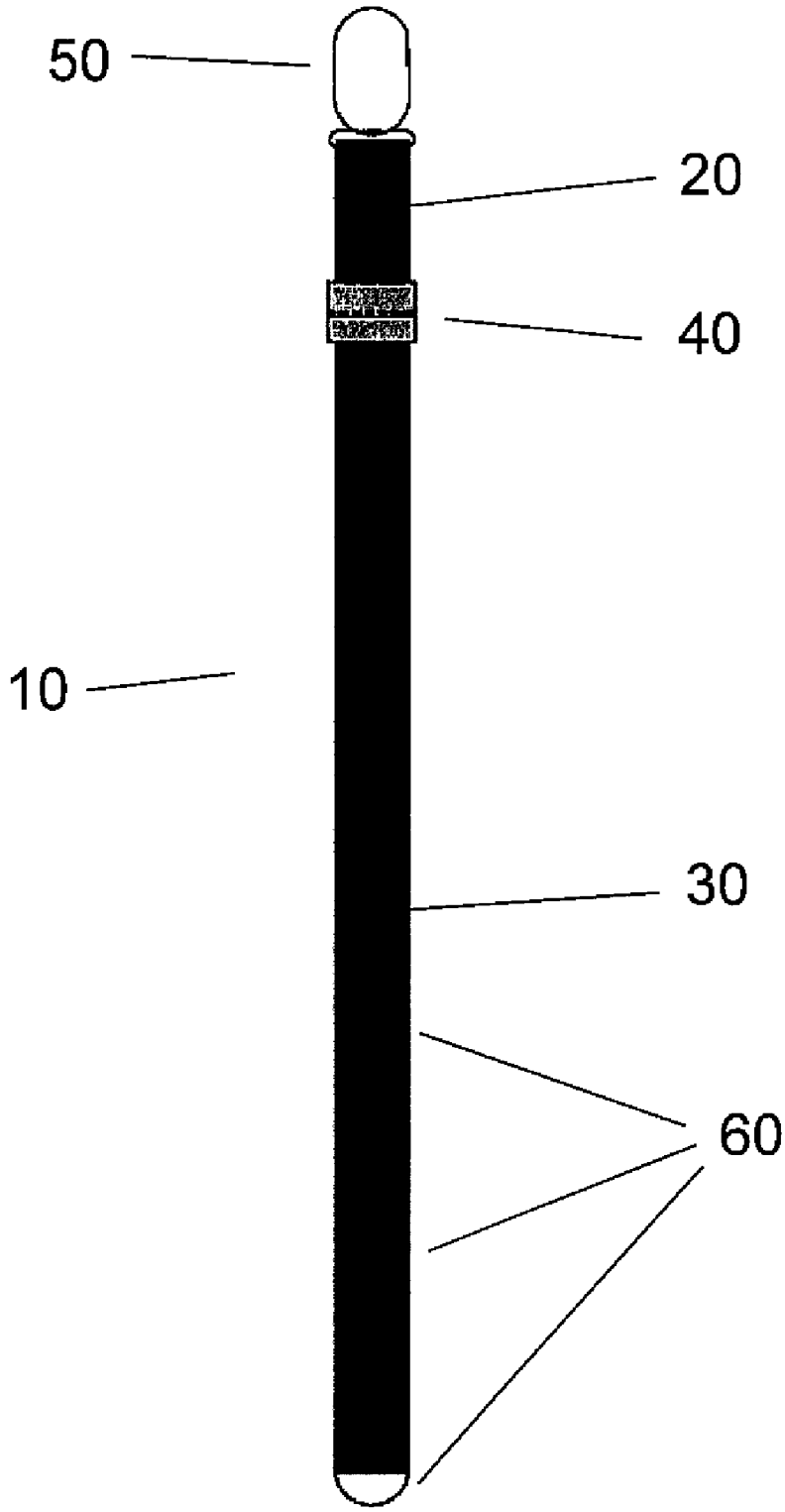
FIG. 1 shows an exercise strap according to the preferred embodiment.

FIG. 1 shows an exercise strap 10 in accordance with the preferred embodiment of the invention. The exercise strap 10 comprises an upper strap 20 and a lower strap 30, separated by an adjustment member 40. Both the upper strap 20 and the lower strap 30 are preferably made from an inelastic material such as nylon. A strap attachment member 50 is preferably located at the top of the upper strap 20. The strap attachment member 50 is used to attach the upper strap 20 to a secure, stationary object. This may include a mount on the top of a door, a ceiling mount, or a frame structure. Preferably, the strap attachment member 50 is a carabiner that is sewn to into the top of the upper strap 20.

The adjustment member 40 allows for the effective overall length of the exercise strap 10 to be adjusted by allowing portions of one or both of the upper strap 20 and lower strap 30 to slide through the adjustment member 40. Preferably, the adjustment member 40 is a cam buckle. Where the adjustment member 40 is a cam buckle, the cam buckle may be permanently sewn to the bottom of the upper strap 20. The top of the lower strap 30 is threaded through the cam buckle, and the amount of the lower strap 30 threaded through the cam buckle determines the effective overall length of the exercise strap 10. When less of the lower strap 30 is threaded through the cam buckle, the overall length of the exercise strap 10 will be longer, whereas when more of the lower strap 30 is threaded through the cam buckle, the overall length of the exercise strap 10 will be shorter (since the portion of the lower strap 30 that is threaded through the cam buckle will not contribute to the effective overall length of the exercise strap 10). The cam in the cam buckle prevents the portion of the lower strap 30 that has been threaded through the cam buckle from sliding backwards, unless the cam is manually released by depressing a button or the like on the cam buckle.

Figure 2:
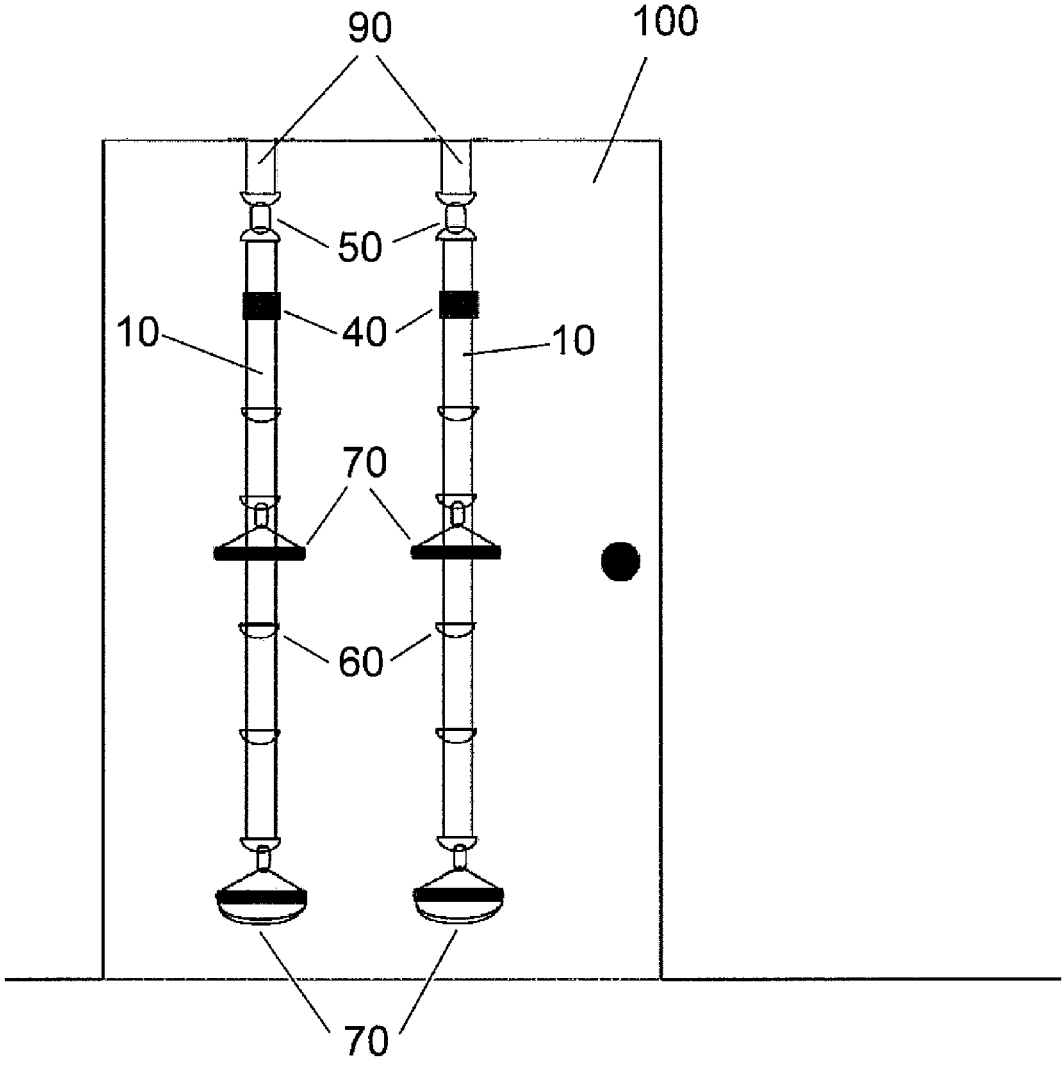
FIG. 2 shows two exercise straps of the preferred embodiment used with a door mount.

A plurality of loop members 60 is located on the lower strap 30. Preferably, the loop members 60 are D-rings sewn into fixed locations on the lower strap 30; however, other types of secure connection members, such as O-rings or carabiners, may also be used. The loop members 60 allow exercise accessories 70, such as handles, to be attached to the lower strap 30, as shown in FIG. 2. Although FIG. 2 shows handles attached to the loop members 60, it is understood that the exercise accessories 70 may comprise other accessories, such as foot cradles, ab straps, or slings, depending on the desired type of exercise. The exercise accessories 70 may be attached to the loop members 60 using conventional attachment parts, such as clips or carabiners.

In the preferred configuration, the upper strap 20 is approximately six inches long and the lower strap 30 is approximately fifty inches long, with five loop members 60 sewn into the lower strap 30. The first of the loop members 60 is sewn approximately ten inches from the top of the lower strap 30, with each of the subsequent loop members 60 being spaced approximately ten inches below the previous one. The last of the loop members 60 would be sewn into the bottom of the lower strap 30. In this preferred configuration, the loop members 60 would be located approximately ten inches apart from each other. The first of the loop members 60 (sewn approximately ten inches from the top of the lower strap 30) would permit only the top ten inches of the lower strap to be threaded through the adjustment member 40, as the size of the loop members 60 prevent them from sliding through the adjustment member 40. This means that the effective overall length of the exercise strap 10 may be adjusted up to approximately ten inches.

The exercise strap 10 may be used in conjunction with a second exercise strap, as shown in FIGS. 2 to 11. FIG. 2 shows the strap attachment members 50 of the two exercise straps 10 attached to door mounts 90. The door mounts 90 are attached to the top of a door 100 and provide secure attachment points for the exercise straps 10. When the exercise straps 10 are used in tandem, it may be often desirable that the loop members 60 of the exercise straps 10 correspond in height with each other so that when the exercise accessories 70 are attached to the loop members 60, the exercise accessories 70 are at the same height. However, even if supposedly identical exercise straps 10 are used with each other, defects in the manufacturing process may result in the loop members 60 of the two exercise straps not being in perfect correspondence to each other in height (e.g. if the upper strap 20 for one of the exercise straps 10 was for some reason slightly shorter than the other). Any such differences can be corrected by using the adjustment member 40 to adjust the length of one of the exercise straps 10 until the loop members 60 are in correspondence.

If the exercise accessories 70 are to be staggered in height for particular exercises, the plurality of fixed locations of the loop members 60 allow for the exercise accessories 70 to be attached to the exercise straps 10 in a number of different combinations. By using the adjustment member 40, precise adjustments can be made to create the desired amount of stagger.

An attached exercise accessory can be easily and quickly removed from one loop member 60 and placed onto another loop member 60 to change its height. For example, when the exercise straps 10 are used to perform push-ups and the exercise accessories 70 (in this case, handles) are attached to the loop members 60, when the handles are placed on the higher loop members 60 (i.e. raising the height of the handles), the difficulty of the ensuing push-ups is decreased. In addition, different muscle groups may be exercised when different heights are used.

The door mount 90 comprises a stopper at one end and a door ring on the other end, both attached together by a cloth strap. The cloth strap is placed over the top of the door 100, with the stopper hanging over one side and the door ring hanging over the other side. The door 100 is closed, and the door ring is attached to the strap attachment member 50. The stopper prevents the door mount 90 from slipping over the top of the door 100. FIG. 2 shows the two exercise straps 10 attached to two door mounts 90 to create a dual suspension system; however, it is also possible to attach two exercise straps 10 to a single door mount 90, which creates a single suspension system.

Figure 3:
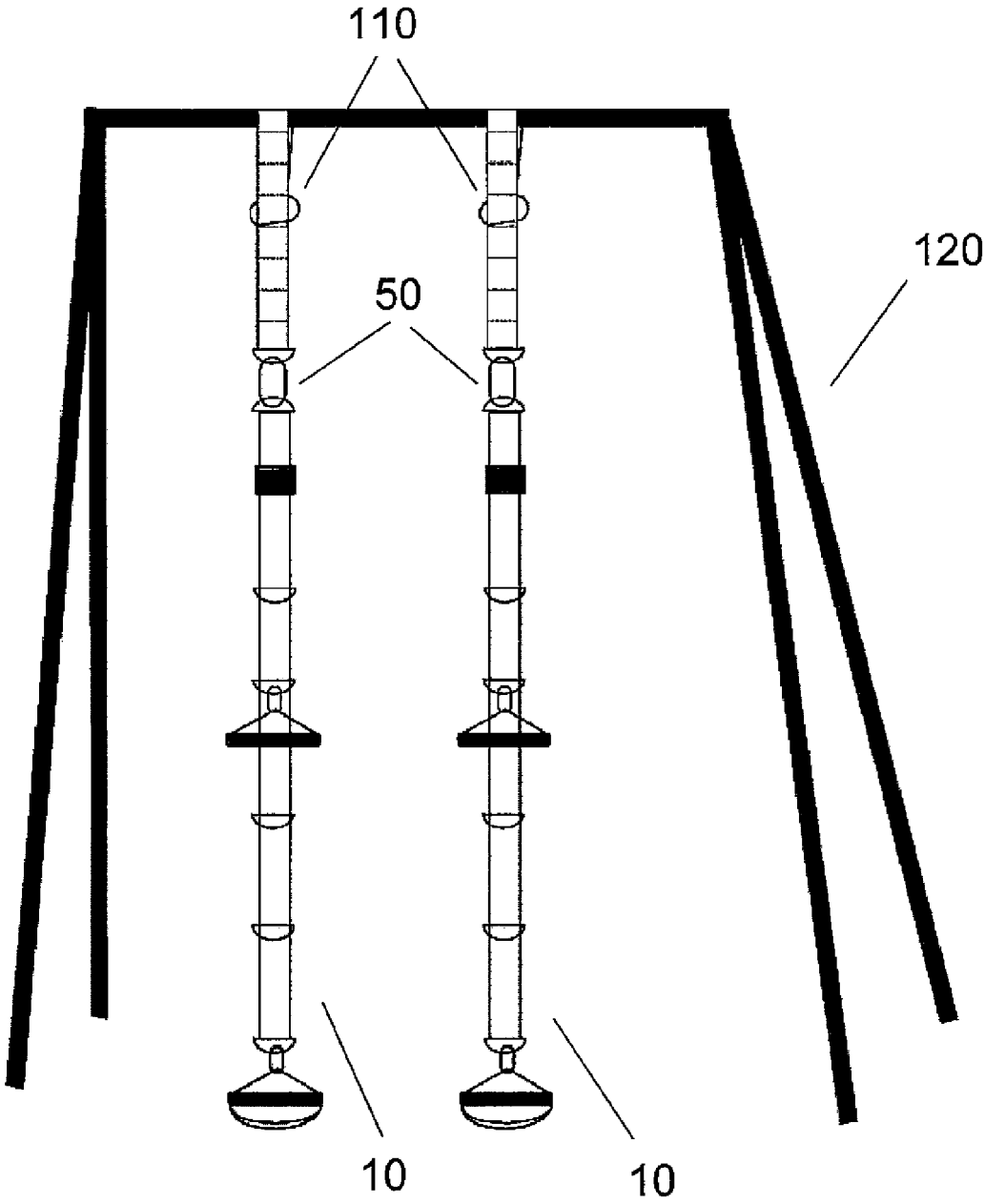
FIG. 3 shows two exercise straps of the preferred embodiment used with a frame structure.

FIG. 3 shows the exercise straps 10 attached to frame mounts 110 of a frame structure 120. The frame structure 120 may be a free-weight squat rack, an outdoor jungle gym, a cable system, or some other sturdy and stable unit. The frame mounts 110 comprise a frame mount strap with a plurality of intermediate loops, with a carabiner secured at one end of the frame mount strap and a D-ring secured to the other end. The frame mount strap is placed over the top of the frame structure 120, and the carabiner is clipped into one of the intermediate loops. The strap attachment member 50 of the exercise strap 10 is attached to the D-ring of the frame mount 110. Preferably, the exercise strap 10 should hang approximately six to eight inches off the ground. When two frame mounts 110 are used, the two exercise straps 10 will form a dual suspension system. However, it is also possible to form a single suspension system by attaching the two exercise straps 10 to a single frame mount 110.

Figure 4:
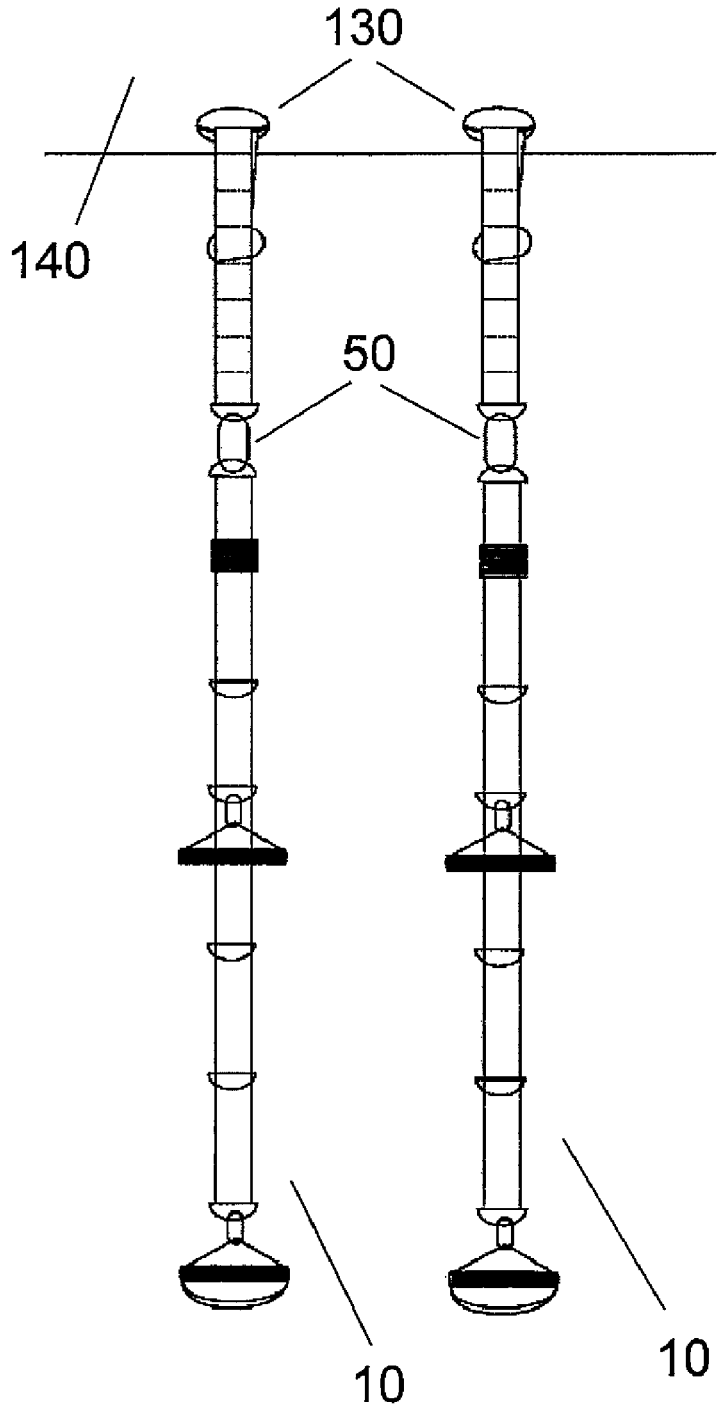
FIG. 4 shows two exercise straps of the preferred embodiment used with a ceiling mount.

FIG. 4 shows two exercise straps 10 attached to ceiling mounts 130 of a ceiling 140. The ceiling mount 130 comprises a metal loop screwed into the joists or support beams of the ceiling 140. The exercise strap 10 can be directly attached to the ceiling mount 130 by attaching the strap attachment member 50 to the metal loop of the ceiling mount 130. Alternatively, the frame mount 110 can be also be used. The frame mount strap would be placed through the metal loop of the ceiling mount 130, and the carabiner would be clipped into one of the intermediate loops. The strap attachment member 50 of the exercise strap 10 would then be attached to the D-ring of the frame mount 110.

Figure 5:
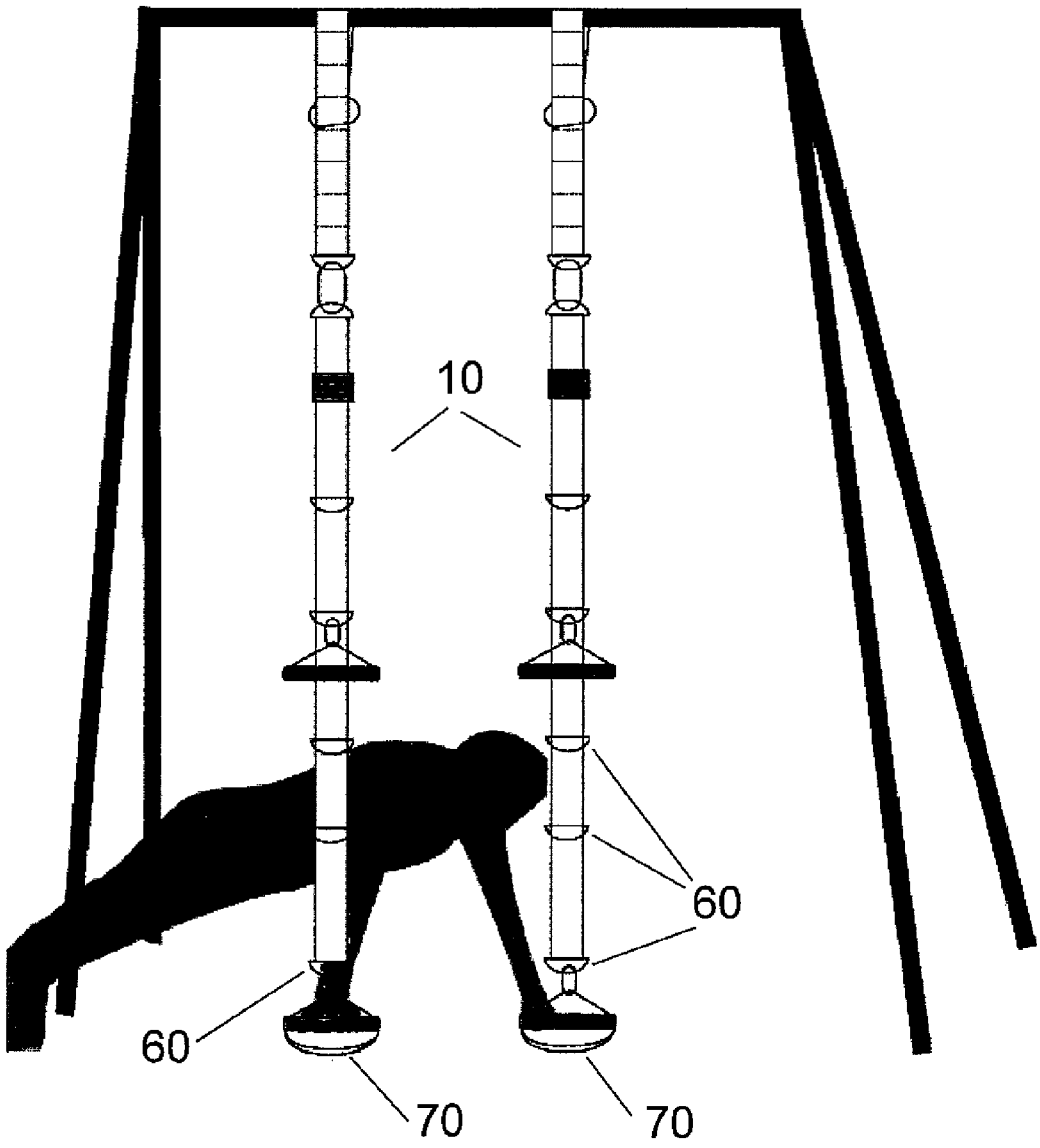
FIG. 5 shows a person using the two exercise straps of the preferred embodiment, with the exercise straps in a vertical position.

FIGS. 5 to 11 show examples of various exercises that can be performed with the exercise straps 10. With reference to FIG. 5, a push-up exercise is shown. The person attaches exercise accessories 70 (in this case, handles) to the bottom loop members 60 of the exercise straps 10. Next, the person places both feet on the ground and walks backwards (while keeping the exercise straps 10 in a vertical orientation) until the feet are far enough behind the body so that the person is in a push-up position (i.e. the legs and back form a straight line). The person then lowers his or her body towards the ground by bending the elbows to the side while keeping the body in a straight position. When the person's elbows form a right angle, the person presses, or "pushes", back to the starting position.

Figure 6:
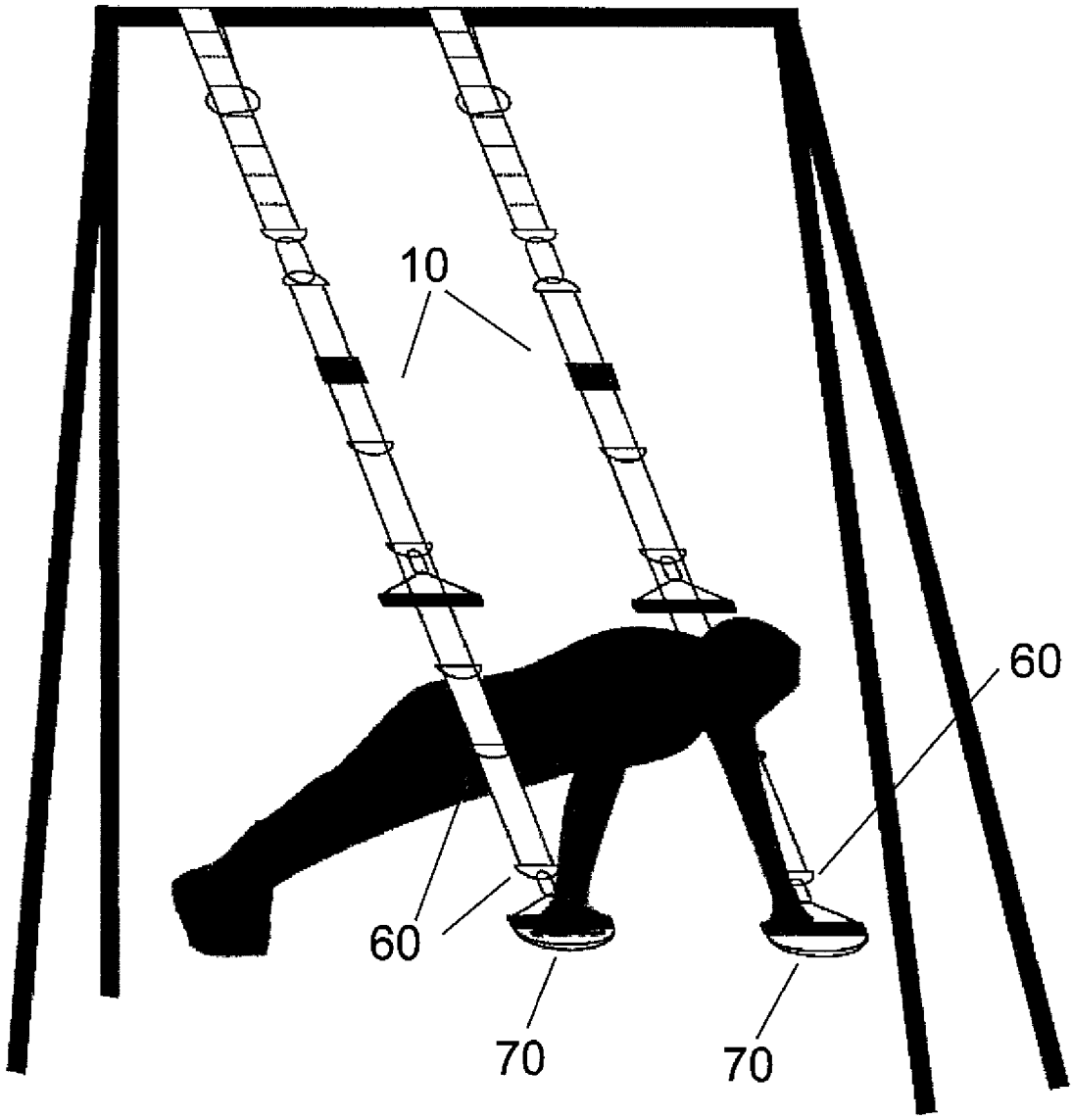
FIG. 6 shows a person using the two exercise straps of the preferred embodiment, with the exercise straps in a non-vertical position.
Figure 7:
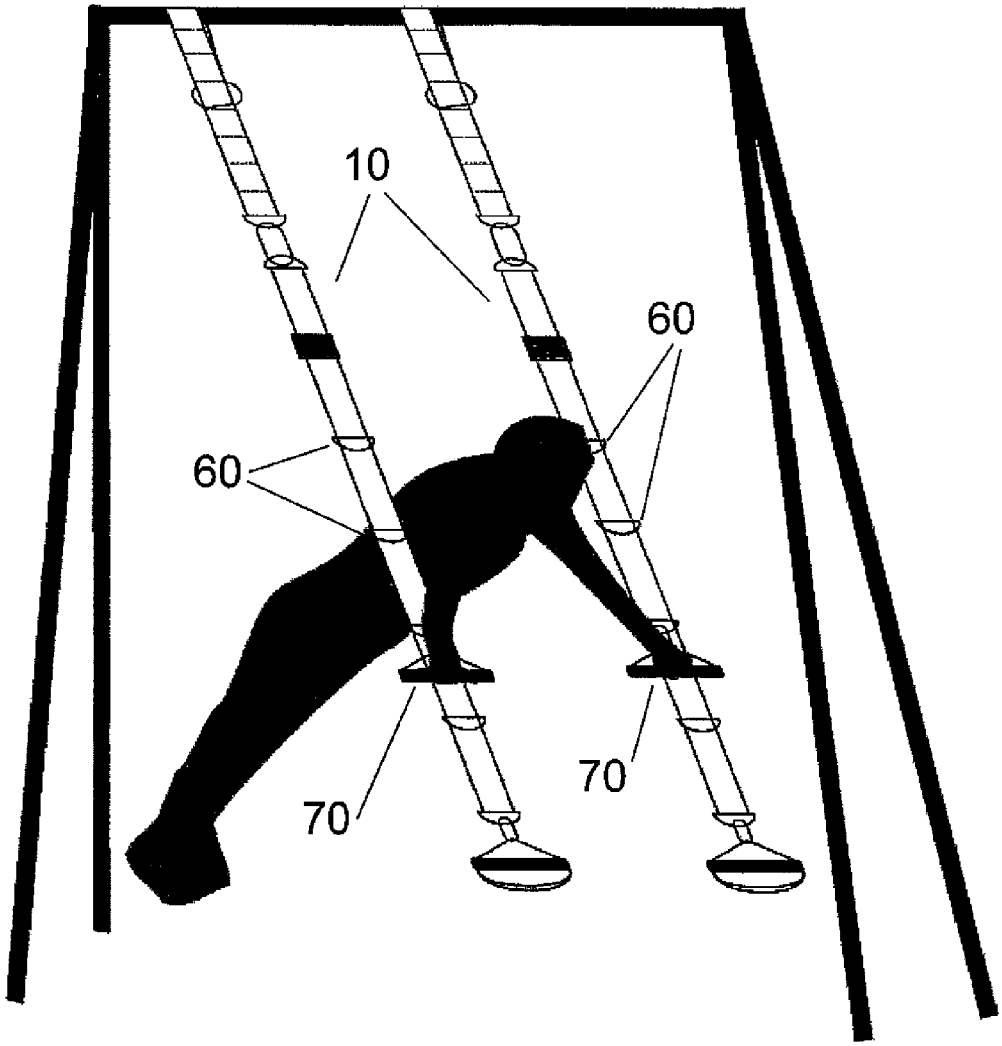
FIG. 7 shows a person using the two exercise straps of the preferred embodiment, using handles further up on the exercise straps.
Figure 8:
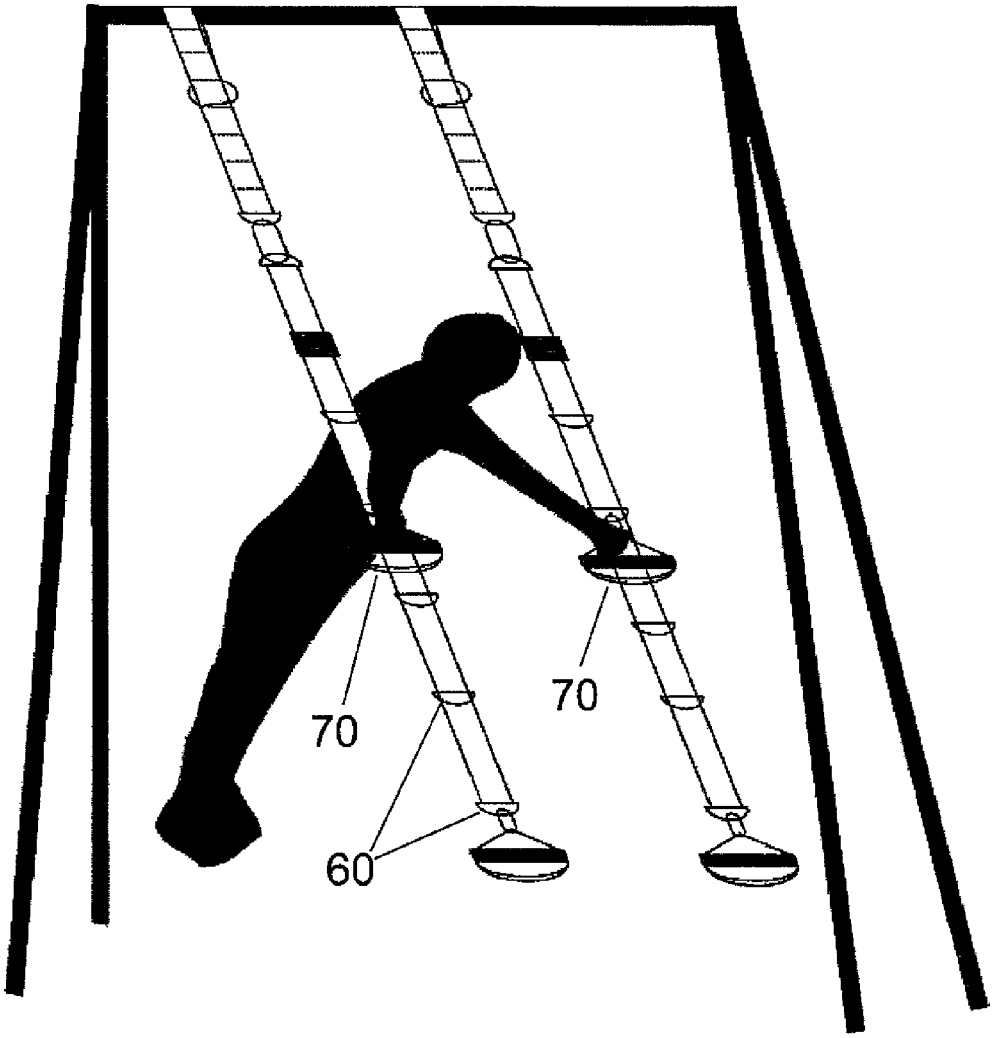
FIG. 8 shows a person using the two exercise straps of the preferred embodiment, using handles still further up on the exercise straps.

If a less difficult form of push-up is desired, the person may walk his or her closer to the original vertical position of the exercise straps 10 (see FIG. 6). This will result in the exercise straps 10 being in a non-vertical orientation, with the person in a stance that is more of a standing position. Alternatively, the person may choose to place the handles higher up on the exercise straps 10 (see FIGS. 7 and 8) to vary the level of difficulty of the push-up.

Figure 9:
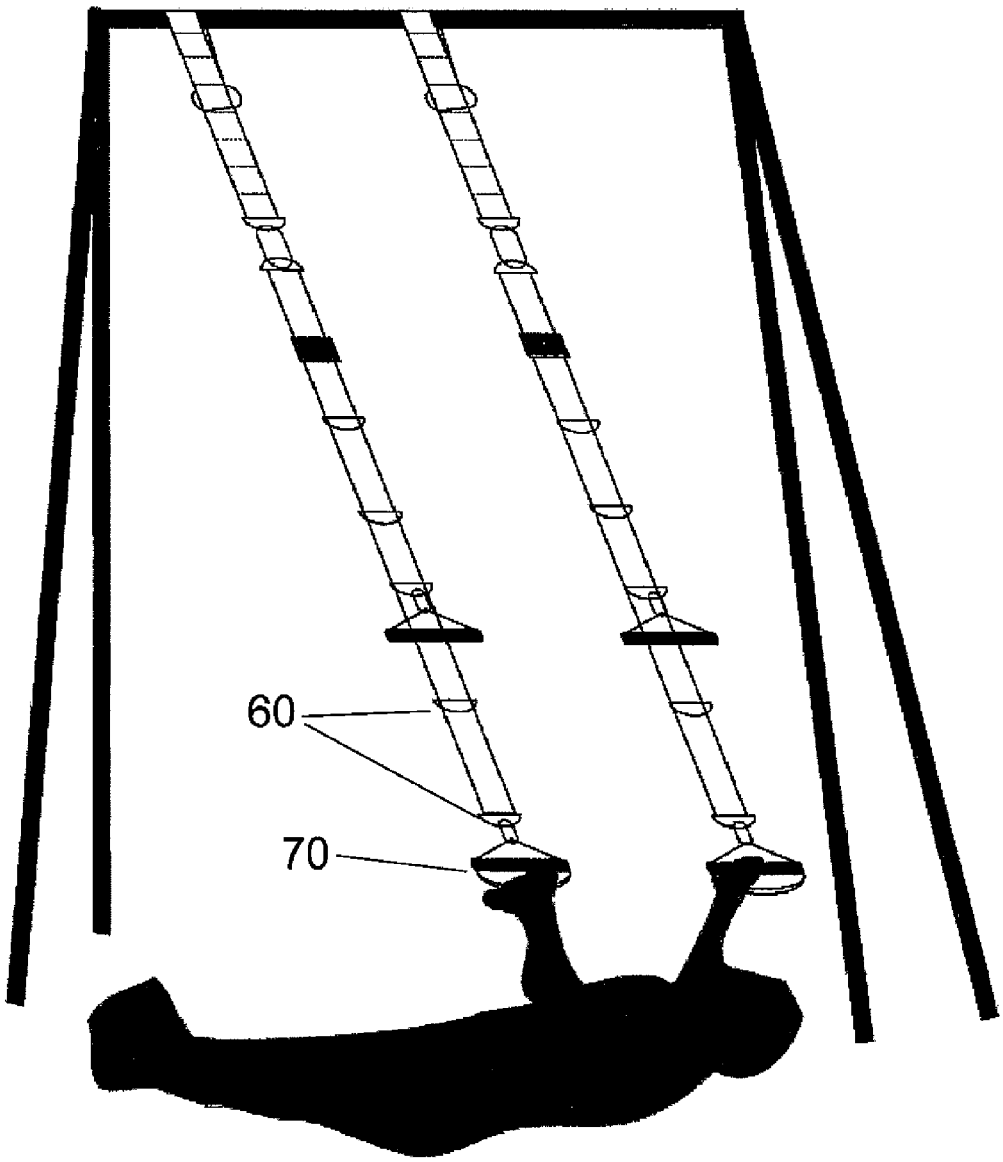
FIG. 9 shows a person using the two exercise straps of the preferred embodiment in an alternate position.

FIG. 9 shows a pull-up exercise for working the upper body. The person, face up, holds the handles with the hands, with both legs extended and both arms extended upwards. The person then retracts both arms in a rowing movement until the arms are bent and reach the chest muscles. As with the push-up exercise, the difficulty of the pull-up exercise can be adjusted by varying the height of the handles, the verticality of the exercise straps 10, and the placement of the feet in relation to the exercise straps 10.

Figure 10:
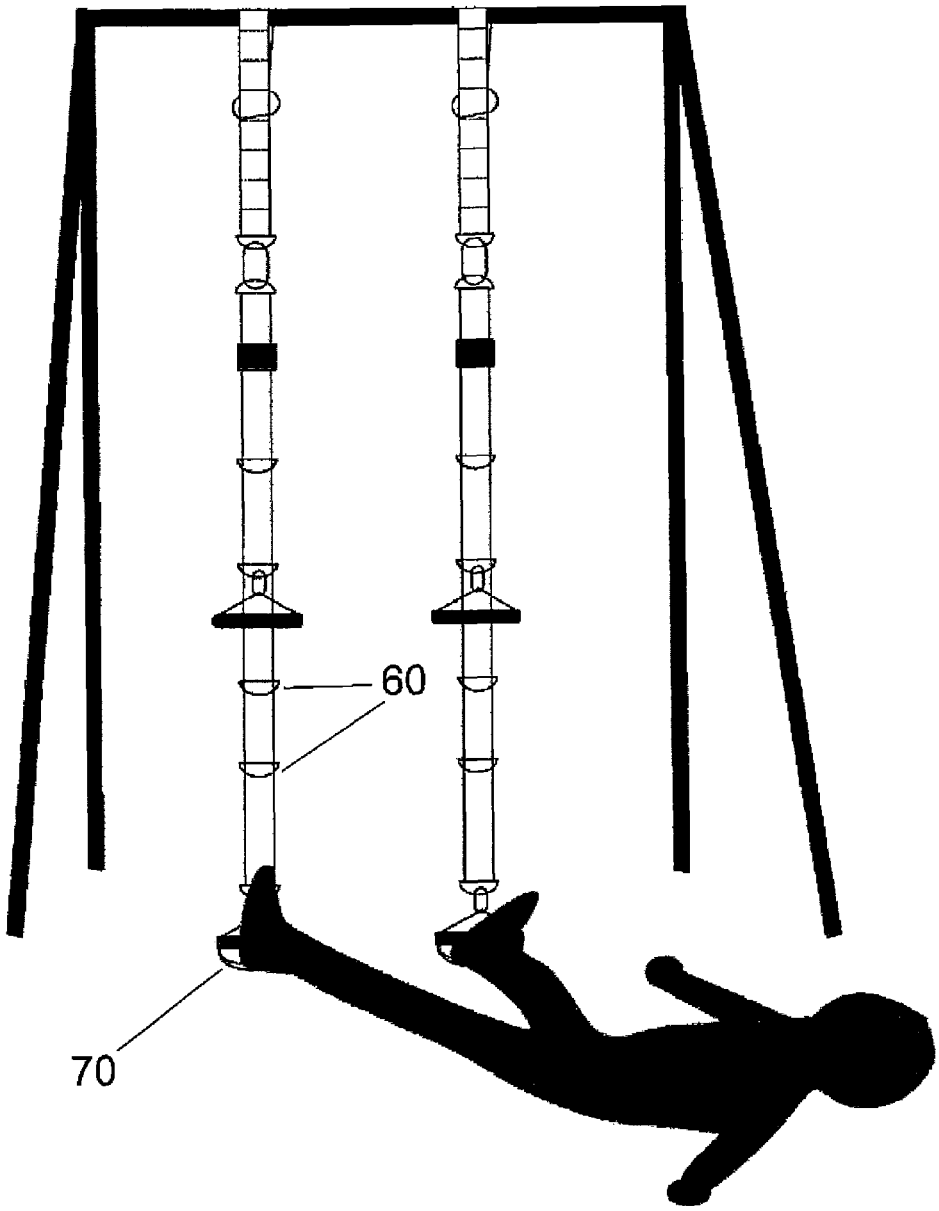
FIG. 10 shows a person using the two exercise straps of the preferred embodiment in a second alternate position.

FIG. 10 shows a hamstring curl exercise. Instead of using handles for the exercise accessories 70, foot cradles are used and are attached to the loop members 60 of the exercise straps 10. The person lies on the ground face up and places the heels of the shoes inside the foot cradles. The arms are placed on the ground to provide support for the body. The person then lifts the hips and lower back off the ground into a supine stabilization and begins to pull both feet in towards the hips while keeping the hips and lower back off the ground, before returning to the starting position. To increase the difficulty of the exercise, the exercise straps 10 should hang non-vertically. To decrease the difficulty of the exercise, the foot cradles can be attached to higher loop members 60 so that they are further off the ground.

Figure 11:
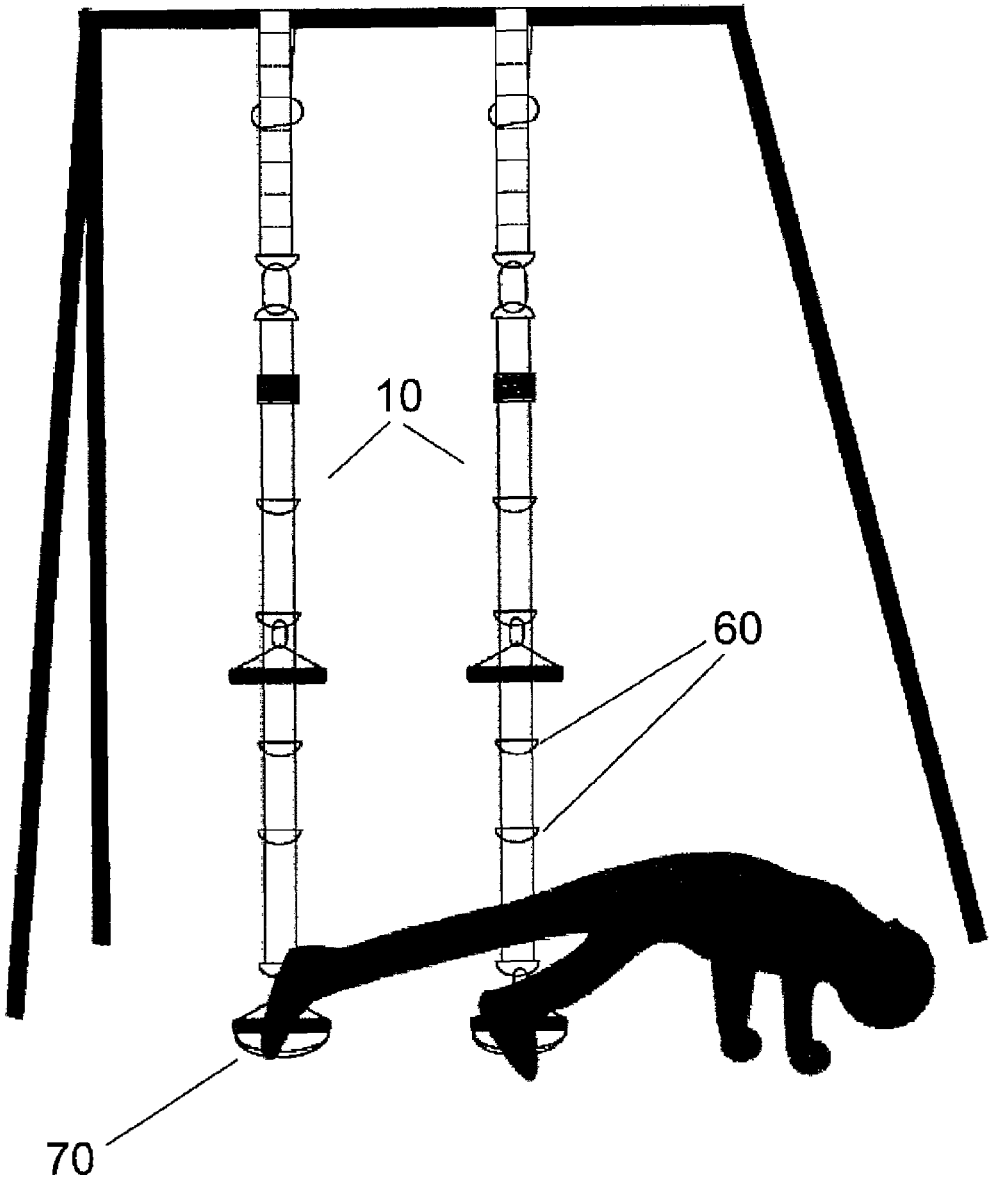
FIG. 11 shows a person using the two exercise straps of the preferred embodiment in a third alternate position.

FIG. 11 shows a pull-in crunch exercise for exercising the upper arms, abdominal muscles, lower back, hip flexor muscles, and the full core region. In this exercise, the exercise accessories 70 (in this case, foot cradles) are attached to the loop members 60. The person places the tops of the shoes inside the foot cradles and then places the hands in front of the body and directly beneath the shoulders. The person, while maintaining a straight back, draws both knees into the chest and upper arms before returning to the starting position. To decrease the difficulty of the exercise, the foot cradles can be attached to higher loop members 60 or the exercise straps 10 can be placed in a vertical orientation.

The exercise straps 10 allows for a full body workout with the capability to isolate both the upper and lower body and core muscles. The exercise straps 10 allow for a person to quickly and easily adjust the location of the handles 70 to vary the type of exercise and/or to vary the level of difficulty of the exercise.

In an alternative embodiment of the invention, the adjustment member 40 is removed; therefore, the upper strap 20 and the lower strap 30 form a unitary strap. This removes the ability to make minute adjustments in the length of the exercise strap 10, but the advantage of being able to quickly change the location of the handle 70 (by attaching it to one of a plurality of loop members 60) remains.

In a further alternative embodiment, one or more of the loop members 60 are located on the upper strap 20. The loop members 60 located on the upper strap 20 will not have the benefit of the height adjustment capability of the adjustment member 40 since those loop members 60 will be above the adjustment member 40.

It will be appreciated by those skilled in the art that the preferred and alternative embodiments have been described in some detail but that certain modifications may be practiced without departing from the principles of the invention.

What is claimed is:

1. An exercise device for use in conjunction with one or more exercise accessories removably attached thereto at selected ones of a plurality of locations along said device, said device comprising:

an upper strap;

a lower strap;

a strap attachment member attached to said upper strap, said strap attachment member suspending said exercise device from above when said exercise device is in use;

three or more loop members, each for removably attaching said exercise accessories thereto, wherein said loop members are spaced apart from each other along said lower strap at said locations; and an adjustment member for adjusting the overall length of said exercise device, wherein said adjustment member is attached to both said upper strap and said lower strap, and wherein a portion of one or both of said upper strap and said lower strap slides through said adjustment member, and wherein said member is a cam buckle and wherein said cam buckle is fixedly attached to said upper strap and wherein said lower strap slides through said cam buckle.

2. The exercise device of claim 1, wherein said upper strap and said lower strap are made of an inelastic material.

3. The exercise device of claim 2, wherein said inelastic material is nylon.

4. The exercise device of claim 1, wherein said strap attachment member is attached to one end of said upper strap.

5. The exercise device of claim 1, wherein said strap attachment member comprises a carabiner.

6. The exercise device of claim 1, wherein said loop members are D-rings.

7. The exercise device of claim 1 wherein said exercise accessory comprises one or more of the following: a handle, a foot cradle, or a sling.

8. An exercise device for use in conjunction with one or more exercise accessories removably attached thereto at selected ones of a plurality of locations along said device, said device comprising:

a first strap;

a second strap;

a strap attachment member attached to said first strap, said strap attachment member suspending said exercise device from above when said exercise device is in use;

said one or more exercise accessories, wherein said exercise accessories comprise one or more of the following: a handle, a foot cradle, or a sling;

three or more loop members, each for removably attaching said exercise accessories thereto, wherein said loop members are spaced apart from each other along said second strap at said locations; and an adjustment member for adjusting the overall length of said exercise device, wherein said adjustment member is attached to both said first strap and said second strap, and wherein a portion of one or both of said first strap and said second strap slides through said adjustment member.

9. The exercise device of claim 8, wherein said first strap and said second strap are made of an inelastic material.

10. The exercise device of claim 8, wherein said strap attachment member comprises a carabiner.

* * * * *

UNITED STATES PATENT AND TRADEMARK OFFICE

CERTIFICATE OF CORRECTION

PATENT NO. : 8,197,392 B2
APPLICATION NO. : 12/849389
DATED : June 12, 2012
INVENTOR(S) : Ben Silverman et al.

It is certified that error appears in the above-identified patent and that said Letters Patent is hereby corrected as shown below:

In the Claims

Column 6, line 25, the portion of claim 1 reading "said member" should read --said adjustment member--

Signed and Sealed this
Twenty-fifth Day of August, 2015

Michelle K. Lee

Michelle K. Lee
*Director of the United States Patent and Trademark Office*